US006300711B1

(12) United States Patent
Yamamoto et al.

(10) Patent No.: US 6,300,711 B1
(45) **Date of Patent: *Oct. 9, 2001**

(54) INDIRECTLY HEATED CATHODE WITH A THERMAL ABSORPTION LAYER ON THE SLEEVE AND CATHODE RAY TUBE

(75) Inventors: Yoji Yamamoto, Hyogo; Katsuyuki Yamashita, Kyoto, both of (JP)

(73) Assignee: Matsushita Electronics Corporation, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/137,894

(22) Filed: Aug. 20, 1998

(30) Foreign Application Priority Data

Aug. 27, 1997 (JP) ..... 9-230605

(51) Int. Cl.[7] ..... H01J 1/20; H01J 19/14
(52) U.S. Cl. ..... 313/337; 313/346 R

(58) Field of Search ..... 313/346 R, 337, 313/311, 346 DC, 338, 340

(56) References Cited

U.S. PATENT DOCUMENTS

| | | | | |
|---|---|---|---|---|
| 4,364,780 | | 12/1982 | Blanken . | |
| 4,637,042 | * | 1/1987 | Braun | 378/143 |
| 5,543,682 | * | 8/1996 | Hara et al. | 313/446 |
| 5,841,222 | * | 11/1998 | Heuvelmans et al. | 313/345 |

* cited by examiner

*Primary Examiner*—Nimeshkumar D. Patel
*Assistant Examiner*—Karabi Guharay
(74) *Attorney, Agent, or Firm*—Merchant & Gould P.C.

(57) ABSTRACT

An indirectly heated cathode that can enhance the withstand voltage and the efficiency of radiating heat from a heater to a tubular sleeve, and a cathode ray tube using such a cathode. The indirectly heated cathode comprises a hot cathode emitting electrons at one end, and a tubular sleeve including a high melting point metal and having a heater inside. A thermal absorption layer is formed on the inside face of the tubular sleeve and the thermal absorption layer contains a boron compound.

10 Claims, 3 Drawing Sheets

INDIRECTLY HEATED CATHODE WITH A THERMAL ABSORPTION LAYER ON THE SLEEVE AND CATHODE RAY TUBE

FIELD OF THE INVENTION

The present invention relates to an indirectly heated cathode used for a television receiver and a computer display, etc., and a cathode ray tube using the same.

BACKGROUND OF THE INVENTION

A conventional indirectly heated cathode comprises a hot cathode emitting electrons at one end and a tubular sleeve comprising a molybdenum material and having a heater inside. In order to enhance the capacity of the tubular sleeve to absorb radiant heat from the heater, an aluminum layer is coated on the inside face of the tubular sleeve and heat-treated in wet hydrogen to form a blackened thermal absorption layer on the inside face of the tubular sleeve (Publication of Japanese Patent Application (Tokkai Sho) No. 56-169778).

However, there are some disadvantages in such an indirectly heated cathode where $Al_3Mo$ is formed on the thermal absorption layer. One of the disadvantages is that while such an indirectly heated cathode integrated into a cathode ray tube is operated, $Al_3Mo$ evaporates from the thermal absorption layer of the indirectly heated cathode. The vapor of $Al_3Mo$ may attach to an electrode located in the vicinity of an indirectly heated cathode, thus causing insulation breakdown. Evaporation of $Al_3Mo$ may make the black thermal absorption layer less black, preventing the tubular sleeve from efficiently absorbing radiant heat from the heater.

SUMMARY OF THE INVENTION

It is therefore an object of the present invention to provide an indirectly heated cathode that can enhance the withstand voltage and the efficiency of radiating heat from a heater to a tubular sleeve, and a cathode ray tube using such a cathode.

According to the present invention, an indirectly heated cathode comprises a hot cathode emitting electrons at one end, a tubular sleeve including a high melting point metal and having a heater inside, and a thermal absorption layer formed on the inside face of the tubular sleeve. The thermal absorption layer contains a boron compound.

Thus, the evaporation of a material from the thermal absorption layer can be inhibited.

Moreover, the cathode ray tube of the present invention comprises a faceplate portion having a fluorescent screen on its inner face; a funnel portion provided behind the faceplate portion; a neck portion, which is formed behind the funnel portion, having an electron gun that emits electron beams; and an indirectly heated cathode that is provided inside the electron gun, the indirectly heated cathode comprising a hot cathode emitting electrons at one end, a tubular sleeve including a high melting point metal and having a heater inside and a thermal absorption layer formed on the inside face of the tubular sleeve. The thermal absorption layer contains a boron compound.

Thus, the attachment of a material to the electrode portion in the tube is prevented and the deterioration of blackening in the thermal absorption layer of the tubular sleeve is inhibited.

It is preferable that the boron compound is a boride.

It is preferable that the boron compound contains at least one element selected from the group consisting of W, Mo, Nb, Sr, Hf, Ta, Ti and Zr.

It is preferable that the boron compound has a melting point of 2000° C. or more.

It is preferable that the thickness of the thermal absorption layer is in the range of 0.5 $\mu$m to 10 $\mu$m.

It is preferable that the tubular sleeve is formed from a substrate including the high melting point metal and having the thermal absorption layer on the substrate.

DETAILED DESCRIPTION OF THE INVENTION

Hereinafter, the present invention will be described by way of embodiments with reference to drawings.

Figure 2:
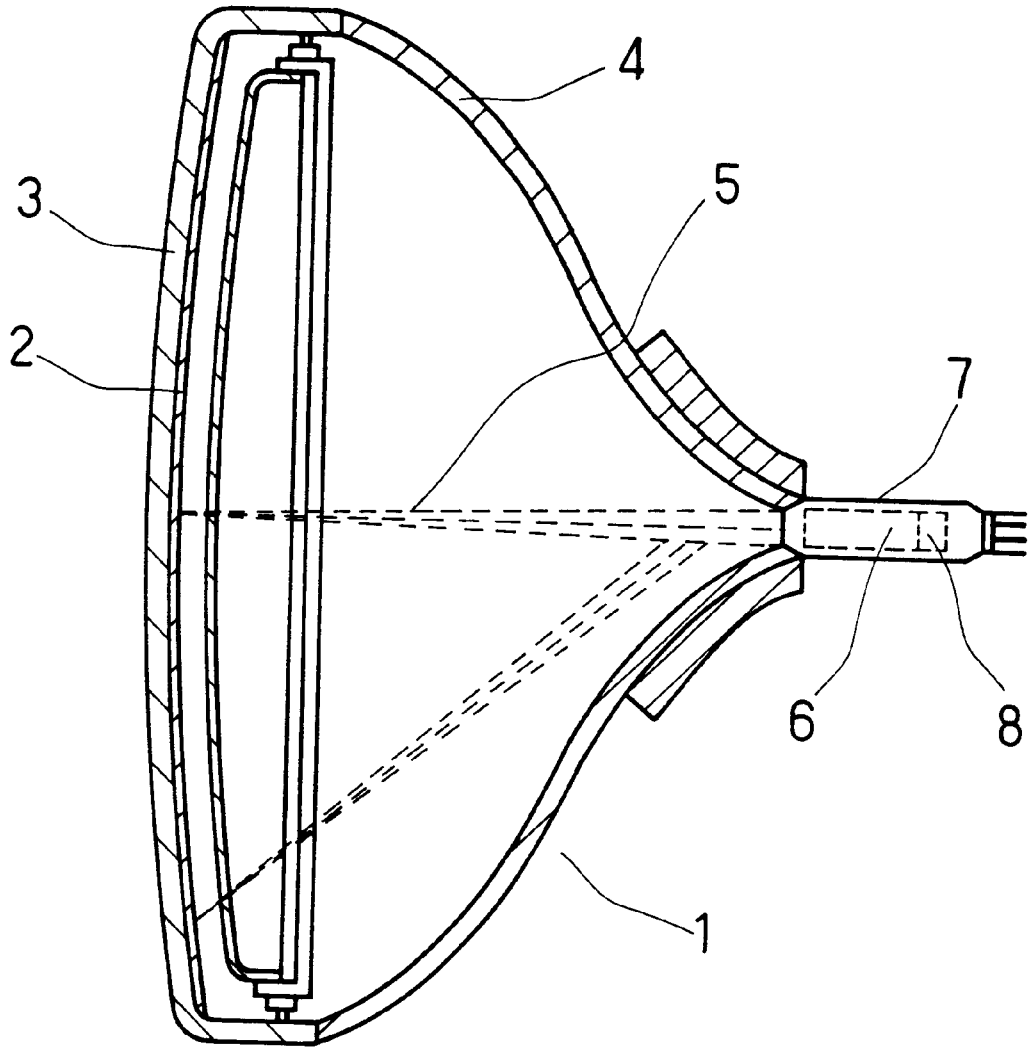
FIG. 2 is a cross sectional view showing a cathode ray tube that utilizes the indirectly heated cathode of the present invention.

As shown in FIG. 2, a cathode ray tube 1 according to the first embodiment of the present invention comprises a faceplate portion 3 having a fluorescent screen 2 on its inner face; a funnel portion 4 provided behind the faceplate portion 3; and a neck portion 7, which is formed behind the funnel portion 4, having an indirectly heated cathode 8 and an electron gun 6 that emits electron beams 5 inside.

Figure 1:
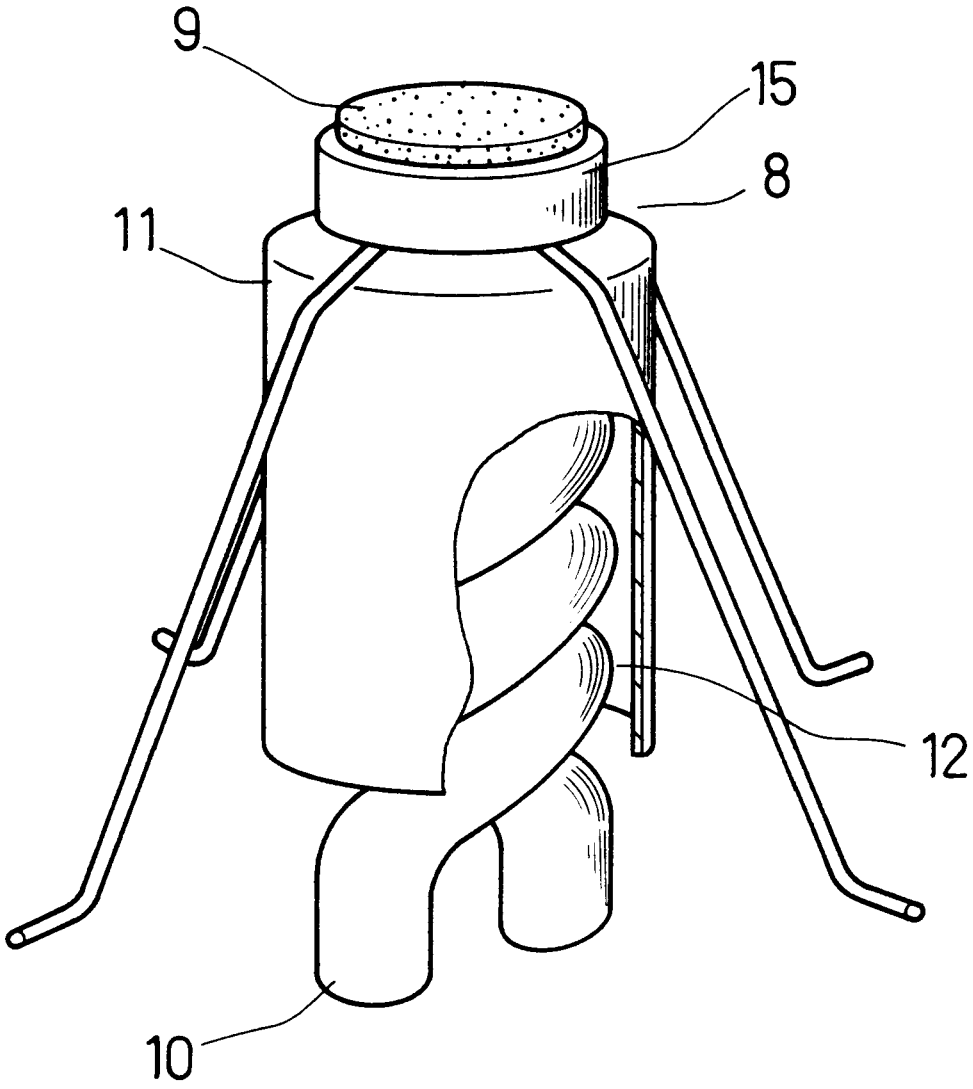
FIG. 1 is a perspective view showing an indirectly heated cathode of the first embodiment of the present invention.

As shown in FIG. 1, the indirectly heated cathode 8 provided at one end of the electron gun 6 comprises a hot cathode 9 formed by a pellet-shaped electron emitter at one end and a tubular sleeve 11 including a high melting point metal such as Mo, Ta, Re and having a coil-type heater 10 inside. On the inside face of the tubular sleeve 11, a thermal absorption layer 12 of a black boride such as $MoB_2$, MoB, $Mo_2B$, WB, $WB_2$, $NbB_2$, $SrB_2$, $HfB_2$, $TaB_2$, TaB, $TiB_2$, TiB, ZrB, $ZrB_2$, $SrB_6$ is formed. In a case where molybdenum is used as the sleeve material, $MoB_2$, $TaB_2$ are preferred since their coefficient of thermal expansion at 100° C. are relatively similar to that of molybdenum. Considering the exfoliation of the thermal absorption layer 12 from the inside face of the tubular sleeve 11 and the deterioration of the blackening of the thermal absorption layer 12, it is preferred that the thickness of the thermal absorption layer 12 is in the range of 0.5 $\mu$m to 10 $\mu$m, more preferably in the range of 1 $\mu$m to 4 $\mu$m.

The thermal absorption layer can include minor components (preferably, around 0.2 weight % or less) other than the boride. However, it does not matter even if each a component is included as long as the object of the present invention can be achieved.

Next, the effect of the above mentioned cathode ray tube 1 will be described.

According to the first embodiment of the present invention, the thermal absorption layer 12 of a black boride is formed on the inside face of the tubular sleeve 11 of the indirectly heated cathode 8. Therefore, the evaporation of material constituting a thermal absorption layer 12 is inhibited even when the cathode ray tube 1 is operated with the hot cathode 9 at 1000 to 1300° C., because the melting point of the boride of the thermal absorption layer 12 is high, i.e. approximately 1800° C. or more. As a result, the attachment of the material to the electrode portion in the tube constituting the electron gun 6 of the cathode ray tube 1 can be prevented, and in turn the withstand voltage can be enhanced. Furthermore, the deterioration of blackening in the thermal absorption layer 12 of the tubular sleeve 11 can be inhibited and the efficiency of radiating heat from the heater 10 to the tubular sleeve 11 can be enhanced.

Furthermore, by making the thickness of the thermal absorption layer 12 in the range 0.5 $\mu$m to 10 $\mu$m, the exfoliation of the thermal absorption layer 12 and the deterioration of the blackening of the thermal absorption layer 12 can be inhibited.

Figure 3A:
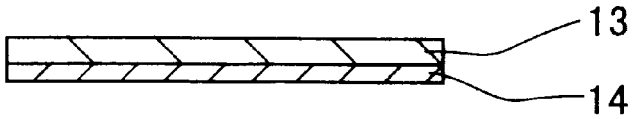
FIG. 3A is a cross sectional view showing a sputtering step for manufacturing a tubular sleeve of the indirectly heated cathode of the present invention.
Figure 3B:
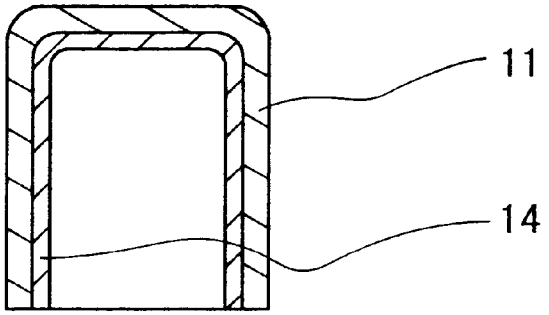
FIG. 3B is a cross sectional view showing a deep-drawing step for manufacturing a tubular sleeve of the indirectly heated cathode of the present invention.
Figure 3C:
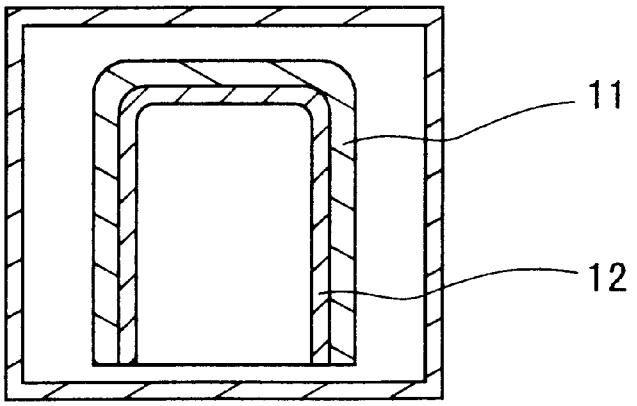
FIG. 3C is a cross sectional view showing a heat treatment step for manufacturing a tubular sleeve of the indirectly heated cathode of the present invention.

FIGS. 3A to 3C show a method for manufacturing the cathode ray tube 8 of FIG. 2. The method comprises a sputtering step (FIG. 3A), a deep-drawing step (FIG. 3B) and a heat treatment step (FIG. 3C). In the sputtering step, $MoB_2$ 14 is deposited over one side of a 100 $\mu$m thick Mo plate 13 that has been heated to 200 to 250° C. In the deep-drawing step, deep-drawing is conducted by press working so that the deposited film of $MoB_2$ 14 is the inside face, and a plurality of tubular sleeves 11 having an outer diameter of 1.8 mm and length of 2.0 mm are manufactured. In the following thermal treatment step, the manufactured tubular sleeves 11 are thermally treated in a reducing atmosphere, for example, an atmosphere of hydrogen, at about 1000° C. for 30 minutes. Then, a cathode assembling step follows. In this step, as shown in FIG. 1, a cup 15 filled with an electron emitting emitter constituting the hot cathode 9 is fixed in the tubular sleeve 11 at one end by laser welding or resistance welding. Then, the coil-type heater 10 is inserted in the tubular sleeve 11.

This method bonds the tubular sleeve 11 comprising Mo and the vapor-deposited film of $MoB_2$ 14 firmly. As a result, even when the cathode ray tube 1 is operated under high temperature, the thermal absorption layer 12 in which the evaporation of $MoB_2$ 14 and deterioration of blackening are inhibited can be obtained. Moreover, since $MoB_2$ 14 is deposited over one side of the Mo plate 13 by sputtering, even if Mo plate 13 on which $MoB_2$ 14 is deposited is deep-drawn, the exfoliation of the deposited film of $MoB_2$ 14 can be inhibited during deep-drawing. Consequently, a great number of tubular sleeves 11 can be manufactured at one time from the Mo plate on which $MoB_2$ 14 is vapor-deposited.

For the comparison with the cathode ray tube 1 of the present invention into which the indirectly heated cathode 8 was integrated, a cathode ray tube into which a conventional indirectly heated cathode was integrated was manufactured with the same method except that the thermal absorption layer 12 was substituted with a conventional aluminum containing layer. The effects of the both cathode ray tubes were evaluated.

After the cathode ray tubes were operated for 1000 hours at high temperature, i.e. at 1200° C., while the rated temperature of the hot cathode 9 is 1000° C., the withstand voltage was tested on the heater 10 and the tubular sleeve 11 to determine the number of defects. In the conventional cathode ray tube, defects in the withstand voltage were observed in 7 out of 100 subjects. On the other hand, no defects were observed in the cathode ray tube of the present invention. These results show that in the cathode ray tube 1 of the present invention, the attachment of $MoB_2$ 14 to the electrode in the tube can be prevented and the deterioration of blackening in the thermally absorption layer 12 in the tubular sleeve 11 can be inhibited.

In the above mentioned embodiment, the deposited film of $MoB_2$ 14 is formed by sputtering. However, instead of sputtering, vacuum evaporation method, a vapor phase growth method and the like may be employed.

Finally, it is understood that the invention may be embodied in other specific forms without departing from the spirit or essential characteristics thereof. The embodiments disclosed in this application are to be considered in all respects as illustrative and not restrictive, so that the scope of the invention being indicated by the appended claims rather than by the foregoing description, and all changes which come within the meaning and range of equivalency of the claims are intended to be embraced therein.

What is claimed is:

1. An indirectly heated cathode comprising a hot cathode emitting electrons at one end, and a tubular sleeve including high melting point metal and having a heater inside, wherein a thermal absorption layer is formed on an inside face of said tubular sleeve, the thermal absorption layer containing a boron compound and absorbing radiant heat from a heater to transmit it to the tubular sleeve, wherein said boron compound is a boride and contains at least one element selected from the group consisting of W, Mo, Nb, Sr, Hf, Ta, and Zr.

2. The indirectly heated cathode according to claim 1, wherein said boron compound is a boride.

3. The indirectly heated cathode according to claim 1, wherein the thickness of said thermal absorption layer is in the range of 0.5 $\mu$m to 10 $\mu$m.

4. The indirectly heated cathode according to claim 1, wherein the boron component has a melting point of 1800° C. or more.

5. The indirectly heated cathode according to claim 1, wherein the tubular sleeve is formed from a substrate including a high melting point metal and having the thermal absorption layer on the substrate.

6. A cathode ray tube comprising;

a faceplate portion having a fluorescent screen on its inside face;

a funnel portion provided behind said faceplate portion;

a neck portion, which is formed behind said funnel portion, having an electron gun emitting electron beams; and an indirectly heated cathode provided in said electron gun, the indirectly heated cathode comprising a hot cathode emitting electrons at one end, and a tubular sleeve including a high melting point metal and having a heater inside, wherein a thermal absorption layer is formed on an inside face of said tubular sleeve, the thermal absorption layer containing a boron compound, wherein said boron compound is a boride and contains at least one element selected from the group consisting of W, Mo, Nb, Sr, Hf, Ta, and Zr.

7. The cathode ray tube according to claim 6, wherein said boron compound is a boride.

8. The cathode ray tube according to claim 6, wherein the thickness of said thermal absorption layer in the range of 0.5 $\mu$m to 10 $\mu$m.

9. The cathode ray tube according to claim 6, wherein the boron component has a melting point of 1800° C. or more.

10. The cathode ray tube according to claim 6, wherein the tubular sleeve is formed from a substrate including a high melting point metal and having the thermal absorption layer on the substrate.

* * * * *